US011534038B2

(12) United States Patent
Chovanec

(10) Patent No.: US 11,534,038 B2
(45) Date of Patent: Dec. 27, 2022

(54) CARRYING CASE

(71) Applicant: Jane Chovanec, Bloomington, MN (US)

(72) Inventor: Jane Chovanec, Bloomington, MN (US)

(73) Assignee: JC Innovations, Bloomington, MN (US)

( * ) Notice: Subject to any disclaimer, the term of this patent is extended or adjusted under 35 U.S.C. 154(b) by 0 days.

(21) Appl. No.: 16/719,654

(22) Filed: Dec. 18, 2019

(65) Prior Publication Data

US 2020/0196808 A1 Jun. 25, 2020

Related U.S. Application Data

(60) Provisional application No. 62/780,992, filed on Dec. 18, 2018.

(51) Int. Cl.

| | |
|---|---|
| ***A45C 13/30*** | (2006.01) |
| ***A47K 10/42*** | (2006.01) |
| ***A45C 13/02*** | (2006.01) |
| *A47K 10/32* | (2006.01) |

(52) U.S. Cl.

CPC ..... *A47K 10/421* (2013.01); *A45C 13/02* (2013.01); *A45C 13/30* (2013.01); *A47K 2010/3266* (2013.01)

(58) Field of Classification Search

CPC ..... A47K 10/421; A47K 2010/326; A45C 3/14; A45C 3/06; A45C 13/30; A45C 13/02

USPC ..... 220/524; 190/112; 224/158, 932; 383/40; 206/349, 776, 778, 466

See application file for complete search history.

(56) References Cited

U.S. PATENT DOCUMENTS

| | | | | |
|---|---|---|---|---|
| 2007/0045334 | A1* | 3/2007 | Sherman | A47K 10/42 221/38 |
| 2007/0241123 | A1* | 10/2007 | Che | B65H 35/10 221/64 |
| 2008/0060972 | A1* | 3/2008 | Rappaport | A45C 15/00 383/117 |
| 2008/0236712 | A1* | 10/2008 | Chisolm | A45C 15/00 150/132 |
| 2011/0309121 | A1* | 12/2011 | Dooley | A45C 7/0086 224/576 |
| 2015/0157113 | A1* | 6/2015 | Anelevitz | A45C 7/0086 224/576 |
| 2016/0113365 | A1* | 4/2016 | Lank | A45C 3/00 383/40 |
| 2019/0053673 | A1* | 2/2019 | Vanchozker | A47K 10/44 |

* cited by examiner

*Primary Examiner* — Rafael A Ortiz

(74) *Attorney, Agent, or Firm* — Winthrop & Weinstine, P.A.; Alicia Griffin Mills; Nadeem W. Schwen

(57) ABSTRACT

The present disclosure relates to novel and advantageous cases for holding multiple items. Particularly, the present disclosure relates to novel and advantageous cases for holding one or more dispensers, wherein product may be dispensed from the dispensers while the items are in the case. More particularly, the present disclosure relates to novel and advantageous cases for holding multiple items and dispensers, at least one of the items or dispensers being pet or child related, wherein product may be dispensed from the dispenser(s) while the dispenser(s) are in the case.

12 Claims, 8 Drawing Sheets

CARRYING CASE

CROSS-REFERENCE TO RELATED APPLICATIONS

The present disclosure claims priority to Provisional Application No. 62/780,992, entitled Flexible Pouch, and filed Dec. 18, 2018, the content of which is hereby incorporated by reference herein in its entirety.

FIELD OF THE INVENTION

The present disclosure relates to novel and advantageous cases for holding multiple items. Particularly, the present disclosure relates to novel and advantageous cases for holding one or more dispensers, wherein product may be dispensed from the dispensers while the items are in the case. More particularly, the present disclosure relates to novel and advantageous cases for holding multiple items and dispensers, at least one of the items or dispensers being pet or child related, wherein product may be dispensed from the dispenser(s) while the dispenser(s) are in the case.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Traveling with a child or pet can be cumbersome. There are frequently many essential items that need to be carried while with the child or pet. These items may be health essentials such as wipes, sanitizers, diaper cream, diapers, disposable bags, and the like, or may be non-health essentials such as keys, credit cards, a phone, and the like. When traveling with many of these essentials, it can be a difficult process to transport the items because of a lack of storage space, such as a lack of pant pocket space. In addition, these items can easily be lost in the mix when stored in large bags or thrown in a drawer. There is a need for a carrying case to ensure optimal organization of items when traveling, such as with a child or pet.

Thus, there is a need in the art for a pouch or carrying case for holding multiple items, including one or more dispensers, wherein product can be dispensed from the dispenser while the dispenser is in the pouch.

BRIEF SUMMARY OF THE INVENTION

The following presents a simplified summary of one or more embodiments of the present disclosure in order to provide a basic understanding of such embodiments. This summary is not an extensive overview of all contemplated embodiments, and is intended to neither identify key or critical elements of all embodiments, nor delineate the scope of any or all embodiments.

In one embodiment, a carrying case is provided having a main body, a pocket, and a connecting device. The main body has an interior and at least one compartment is provided in the interior. The at least one compartment has an aperture in a wall of the compartment, the aperture being configured for receiving an item from the interior of the main body such that the item may be dispensed from the interior of the main body. The pocket is disposed on an outer surface of the main body. The pocket has a front panel and window through the front panel. The window is configured for accessing an item placed in the pocket. The connecting device may be used to attach the carrying case to a user or to an item associated with a user.

In another embodiment a pouch is provided having a first pocket, a second pocket, and a connecting device. The first pocket is configured for receiving a packaged product and includes a slot through which product may be dispensed. The second pocket is configured for receiving a dispenser. The height of the second pocket is less than the height of the first pocket such that a user can dispense from the dispenser without removing the dispenser from the second pocket. The connecting device may be used to attach the pouch to a user or to an item associated with a user.

While multiple embodiments are disclosed, still other embodiments of the present disclosure will become apparent to those skilled in the art from the following detailed description, which shows and describes illustrative embodiments of the invention. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the various embodiments of the present disclosure, it is believed that the invention will be better understood from the following description taken in conjunction with the accompanying Figures, in which:

DETAILED DESCRIPTION

The present disclosure relates to novel and advantageous cases for holding multiple items. Particularly, the present disclosure relates to novel and advantageous cases for holding one or more dispensers, wherein product may be dispensed from the dispensers while the items are in the case. More particularly, the present disclosure relates to novel and advantageous cases for holding multiple items and dispensers, at least one of the items or dispensers being pet or child related, wherein product may be dispensed from the dispenser(s) while the dispenser(s) are in the case.

In various embodiments, a carrying case may be provided having a plurality of pockets for receipt of various items, at least one of the pockets having an aperture from which a product in an item may be removed from the carrying case without opening the carrying case, and one or more connecting devices for attaching the carrying case to another object to facilitate easy carriage. The carrying case may be formed from any suitable material. In one embodiment, the pouch is formed from a water resistant polyester. In some embodiments, the carrying case may be a flexible pouch.

Figure 1A:
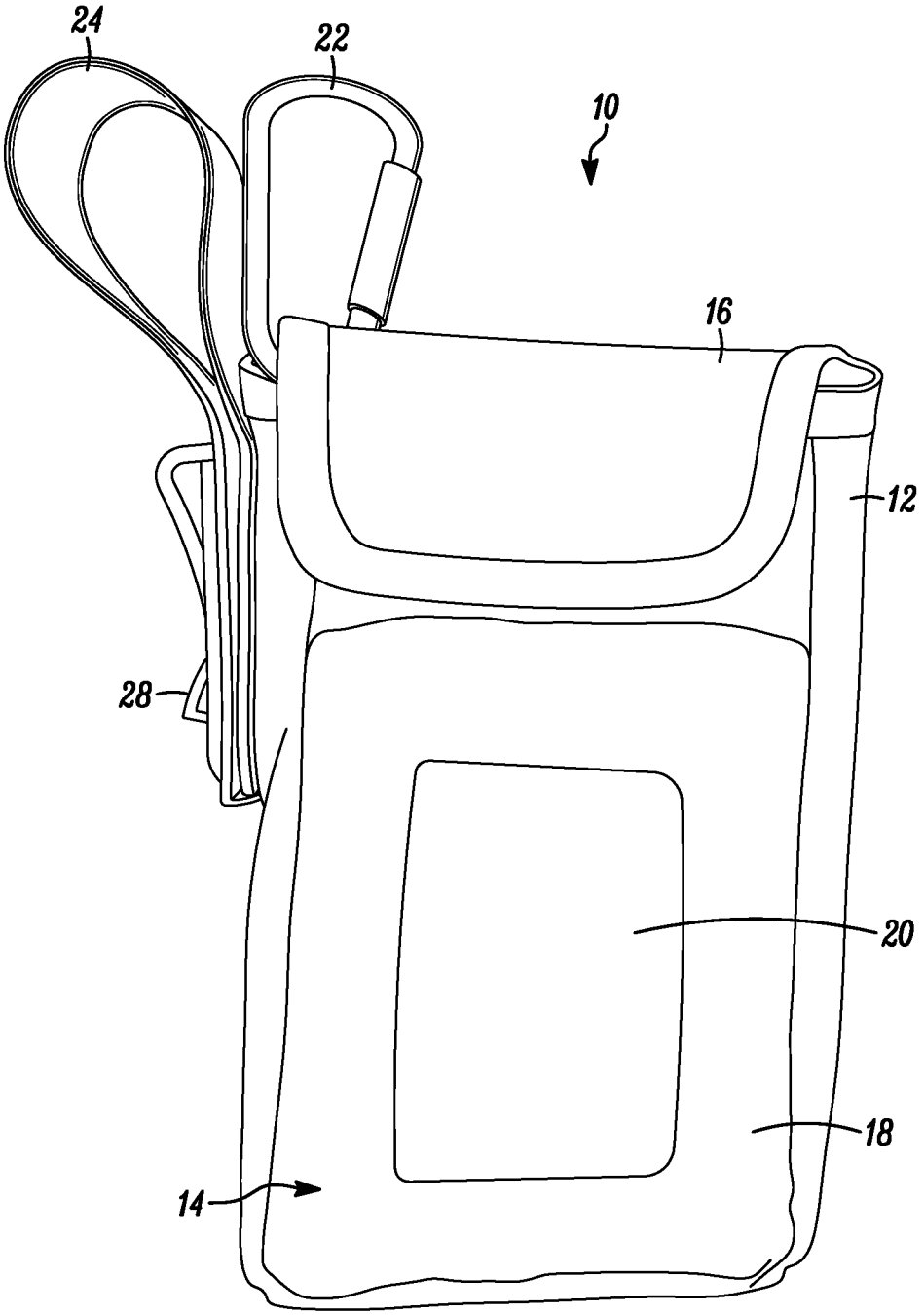
FIG. 1*a* illustrates a front view of a carrying case, in accordance with one embodiment.
Figure 1B:
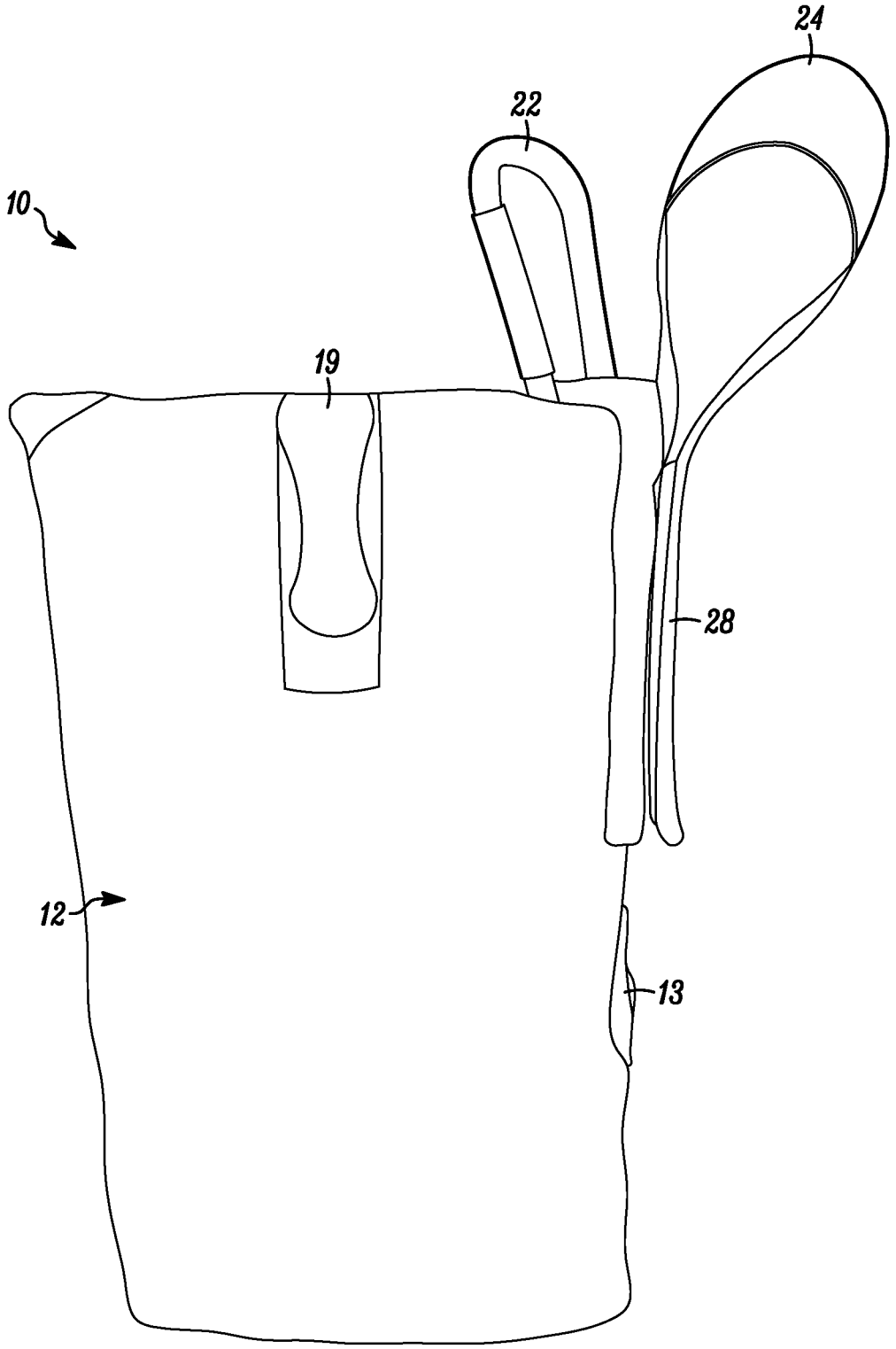
FIG. 1*b* illustrates a side view of the carrying case of FIG. 1*a*.
Figure 2:
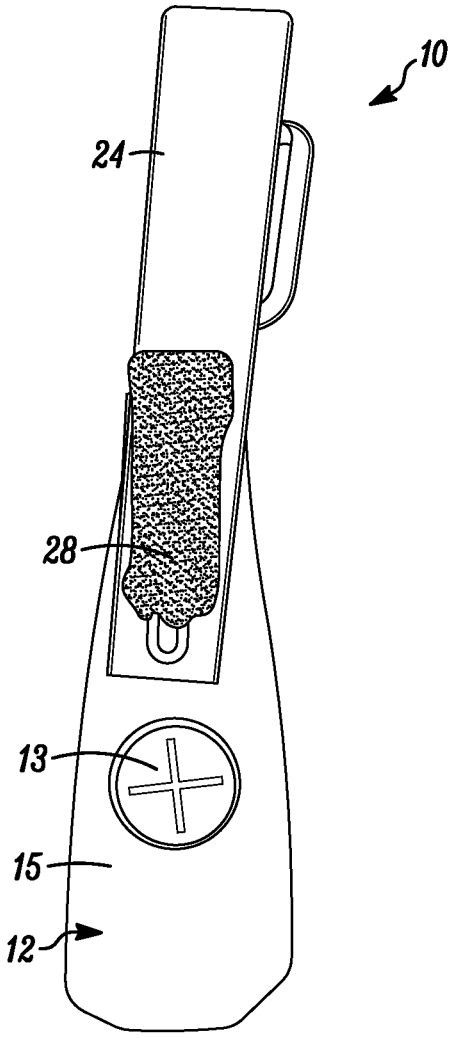
FIG. 2 illustrates a side view of the carrying case of FIG. 1*a*.

FIGS. 1*a*, 1*b*, and 2 illustrate front, back, and side views, respectively, of a carrying case or pouch, in accordance with a first embodiment. In the embodiment shown, the carrying case 10 includes a main body 12 and a packet pocket 14. The main body 12 includes an aperture 13, for example along a side surface 15 of the main body 12. The main body includes a closure 16. The closure 16 may be, for example, a flap. The closure 16 may extend some or all of the packet pocket 14. In other embodiments, other closures, such as zippers or hook and eye closures, may be used and the closure for the main body may be separate from a closure for the packet pocket. The packet pocket 14 includes a front panel 18 and an aperture or window 20 in the front panel.

The carrying case 10 further includes a connecting device 22 such as a grommet, a chain, a flexible rubber binder, a string, a clip, or any other connecting device capable of attaching the carrying case to a user or an item that is associated with the user. The item can include a purse, a belt, a leash, clothing, a backpack, a stroller, or a shopping cart, for example. For example, the connecting device 22 may be a carabineer clip for attaching the carrying case 10 to a leash. The carrying case 10 may further include a strap 24. A hook and eye closure or other fixing mechanism 28 may be used to fix the strap 24 in a storage position.

In various embodiments, one or more of a variety of connecting devices may be used. For example, a hook and eye closure 28 may be used to attach the carrying case to a pant belt loop. A clip, such as a plastic clip, may be provided for attaching the carrying case to a pant waist. In one embodiment, such a clip 19 may be provided on a rear surface of the carrying case so that the front of the pouch remains accessible. A carabineer clip 22 may be provided for attaching the carrying case to a leash or a stroller.

The carrying case may have a plurality of compartments, for example a pocket and a main body, the main body itself being divided into a plurality of compartments. The various compartments may be used for organizing and, in some cases, providing easy access to items including health essentials such as wipes, sanitizers, diaper cream, diapers, disposable bags, and the like, and non-health essentials such as keys, credit cards, a phone, and the like.

In some embodiments, the main body 12 may be divided into compartments in the interior. The main body 12 may be used for holding a variety of items. For example, a compartment of the main body 12 having aperture 13 through a side surface thereof may be used to hold a dispenser of a product. In other embodiments, the aperture may be provided in an alternative surface of the main body 12. In one embodiment, the compartment of the main body 12 may hold a roll of bags, such as bags used for collecting dog waste or holding a dirty diaper, with a bag extending through the aperture 13 such that a bag may be removed from the carrying case without opening the main body 12. Other compartments in the main body 12 may be used for holding other items, such as a phone, keys, treats, credit card, etc.

The packet pocket 14 may be used for holding a dispenser of a different kind of product. In general, the packet pocket is capable of holding a commercial packet that can dispense paper, cloth, or nonwoven products such as hand wipes, baby wipes, or facial tissue. For example, the packet pocket 14 may be used for holding a packet of wipes or tissues. Such packet of wipes may have a reusable seal that is exposed through the window 20. Accordingly, a user may remove a wipe from the packet of wipes provided in the front packet without needing to open the carrying case or to remove the packet of wipes from the carrying case. In some embodiments, the packet pocket 14 may have an open edge, such as an open top edge, such that the dispenser may be slid into the packet pocket 14.

Figure 4:
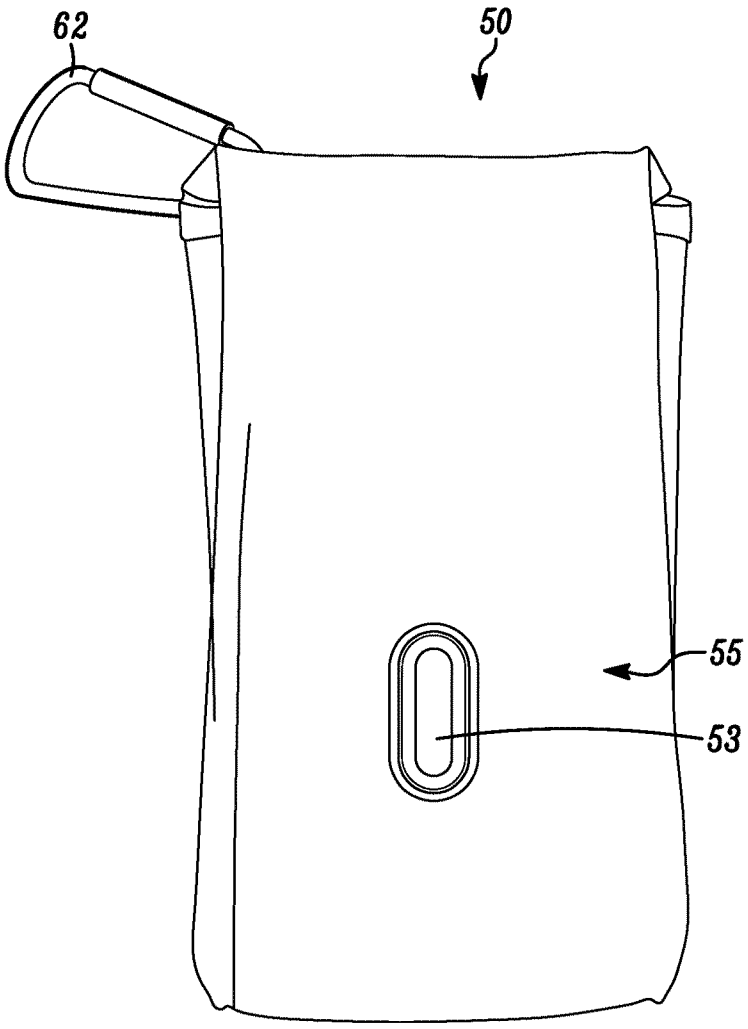
FIG. 4 illustrates a back view of the carrying case of FIG. 3.
Figure 3:
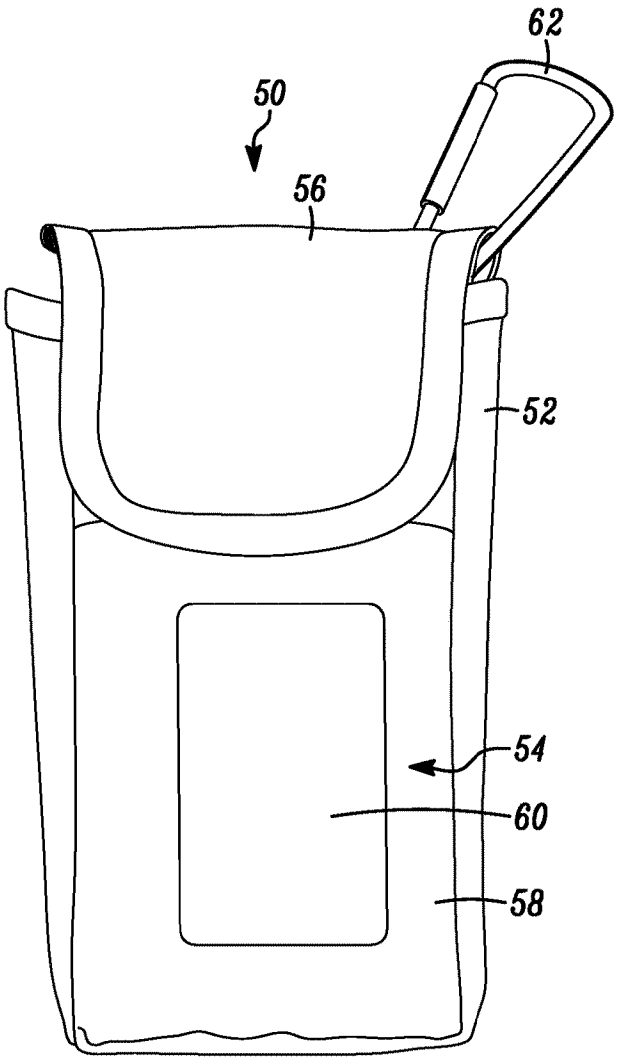
FIG. 3 illustrates a front view of a carrying case, in accordance with another embodiment.

FIGS. 3 and 4 illustrate a front and back views, respectively, of a carrying case or pouch, in accordance with a second embodiment. In the embodiment shown, the carrying case 50 includes a main body 52 and a packet pocket 54. The main body 52 includes an aperture 53, for example along a back surface 55 of the main body 52. The main body includes a closure 56. The closure 56 may be, for example, a flap. The closure 56 may extend some or all of the packet pocket 54. In other embodiments, other closures, such as zippers or hook and eye closures, may be used and the closure for the main body may be separate from a closure for the packet pocket. The packet pocket 54 includes a front panel 58 and an aperture or window 60 in the front panel.

The carrying case 50 further includes a connecting device 62 such as a grommet, a chain, a flexible rubber binder, a string, a clip, or any other connecting device capable of attaching the carrying case to a user or an item that is associated with the user. The item can include a purse, a belt, a leash, clothing, a backpack, a stroller, or a shopping cart, for example. For example, the connecting device 62 may be a carabineer clip for attaching the carrying case 50 to a leash.

In some embodiments, the main body 52 may be divided into compartments in the interior. The main body 52 may be used for holding a variety of items. For example, a compartment of the main body 52 having aperture 53 through a back surface thereof may be used to hold a dispenser of a product. In one embodiment, the compartment of the main body 52 may hold a roll of bags, such as bags used for collecting dog waste, with a bag extending through the aperture 53 such that a bag may be removed from the pouch without opening the main body 52. Other compartments in the main body 52 may be used for holding other items, such as a phone, keys, treats, credit card, etc.

The packet pocket 54 may be used for holding a dispenser of a different kind of product. For example, the packet pocket 54 may be used for holding a packet of wipes. Such packet of wipes may have a reusable seal that is exposed through the window 60. Accordingly, a user may remove a wipe from the packet of wipes provided in the front packet without needing to open the carrying case or to remove the packet of wipes from the pouch. In some embodiments, the packet pocket 54 may have an open edge, such as an open top edge, such that the dispenser may be slid into the packet pocket 54.

Figure 5:
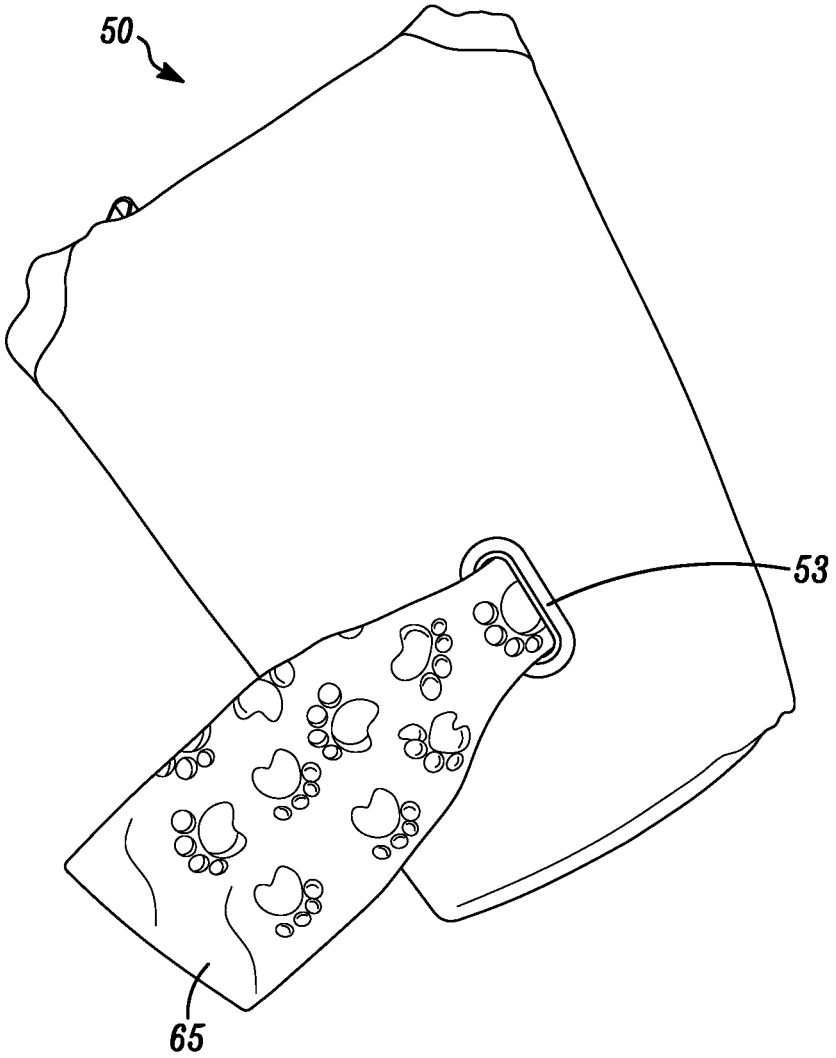
FIG. 5 illustrates a back view of the carrying case of FIG. 3 with bags extending from an aperture in the pouch.

FIG. 5 illustrates a back view of the carrying case 50 of FIG. 3 with bags 65 extending from an aperture 53 in the carrying case.

Figure 6:
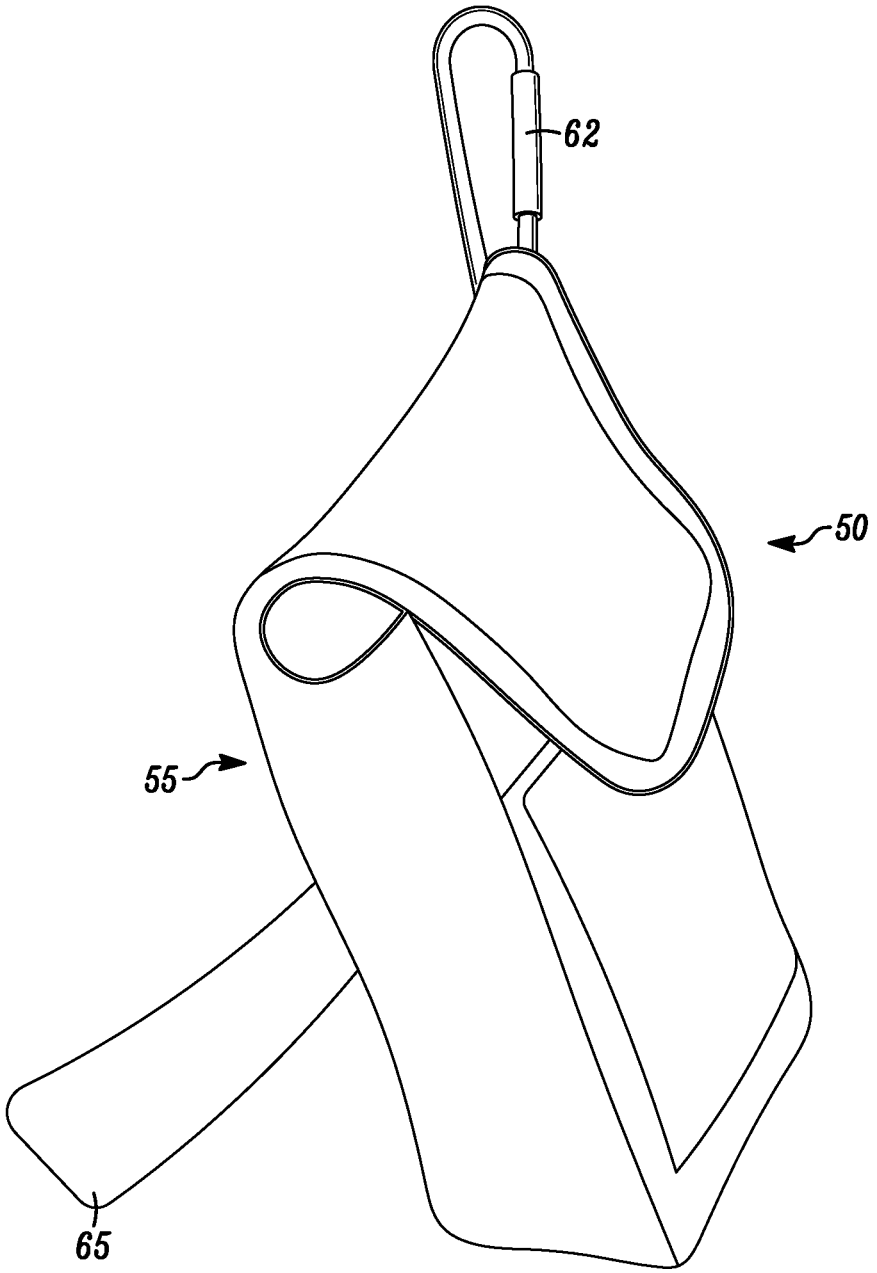
FIG. 6 illustrates a perspective view of the carrying case of FIG. 3 attached to a leash, in accordance with one embodiment.

FIG. 6 illustrates a perspective view of the pouch of FIG. 3 attached to a leash, in accordance with one embodiment. As shown, the carrying case 50 may be attached to a leash 67 using the connecting device 62, such as a carabineer clip. In the figure, bags 65 extend from a back surface 55 of the carrying case 50.

Figure 7:
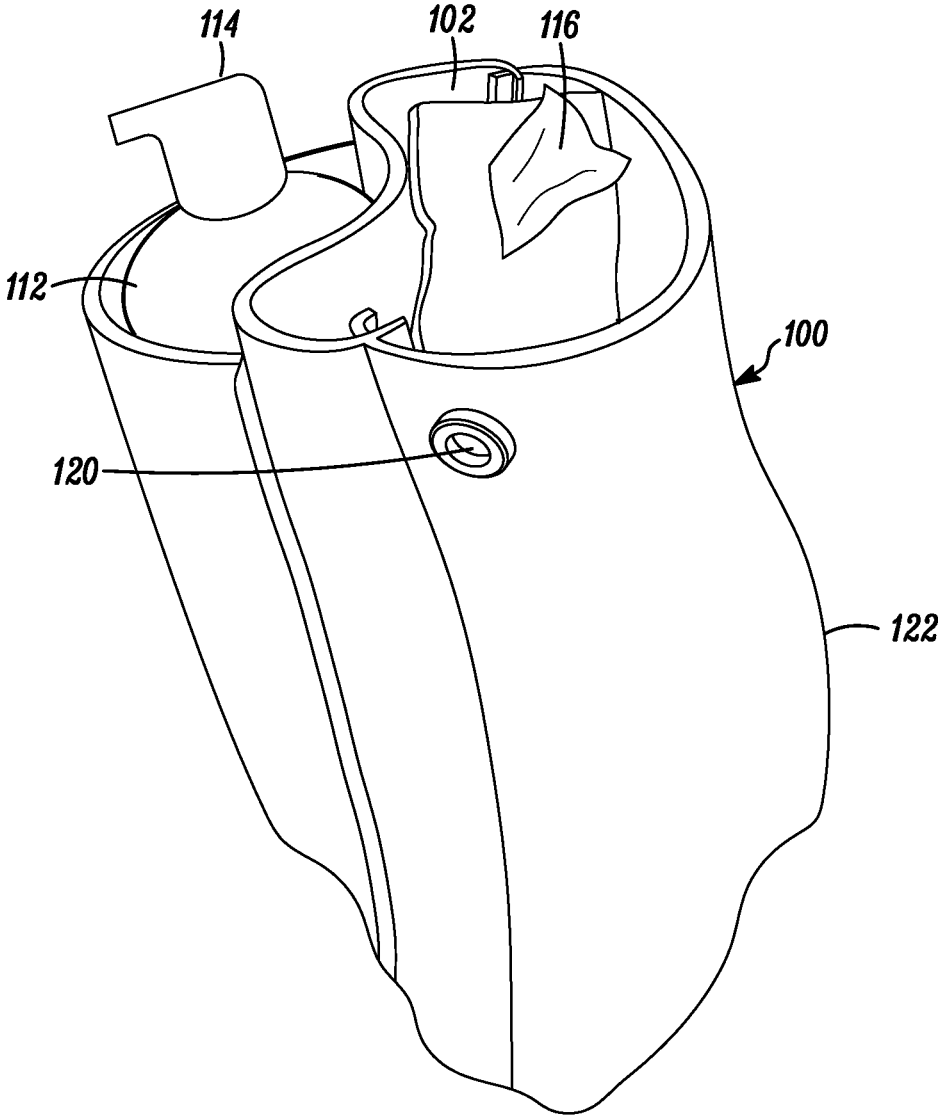
FIG. 7 illustrates a top perspective view of a pouch with items in place in the pouch, in accordance with a further embodiment.
Figure 8:
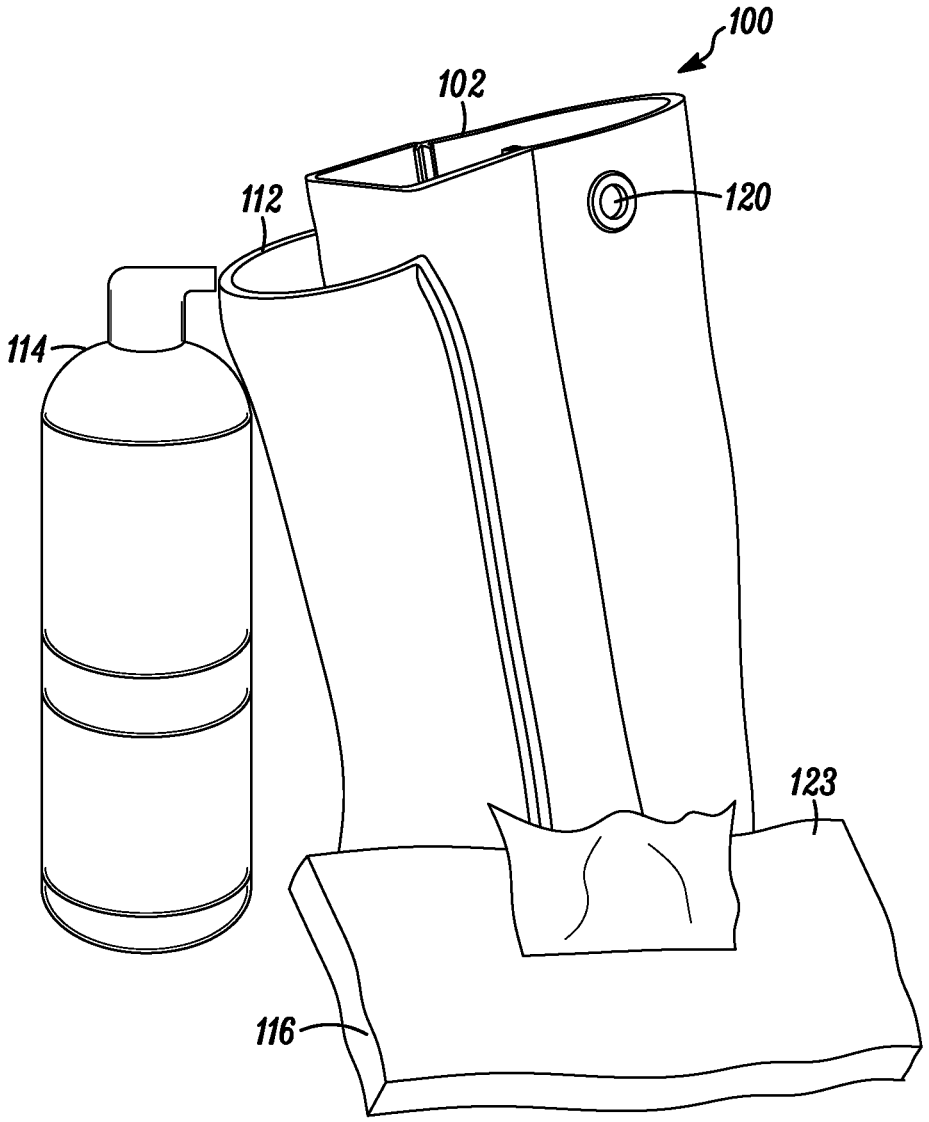
FIG. 8 illustrates a side view of the embodiment of FIG. 7 with the items removed.

FIG. 7 illustrates a top perspective view of a pouch with items in place in the pouch, in accordance with a further embodiment. FIG. 8 illustrates a side view of the embodiment of FIG. 7 with the items removed. In general, the pouch or carrying case may be a flexible pouch for holding, for example, packaged commercial products. The pouch includes two or more pockets, such as a dispenser pocket and a packet pocket. The dispenser pocket may be capable of holding a dispensing container that can dispense at least one of a liquid or powder. In some embodiments, the dispensing container can dispense personal care products such as, but not limited to, shampoo, conditioner, deodorant, fragrance, hand sanitizer, or lotion. The packet pocket is capable of holding a commercial packet that can dispense paper, cloth, or nonwoven products such as hand wipes, baby wipes, or facial tissue. In some embodiments, the pockets are contoured to fit the at least one dispensing container and the at least one solid packet dispenser. The flexible pouch also includes a connecting device such as a grommet, a chain, a flexible rubber binder, a string, a clip, or any other connecting device capable of attaching the flexible pouch to a user or an item that is associated with the user. The item can include a purse, a belt, a leash, clothing, a backpack, a stroller, or a shopping cart, for example.

The flexible pouch can include at least one aperture or slot in the packet pocket that is capable of dispensing product from the packet pocket, through the flexible pouch and to the end user. The dispenser pocket can have dimensions of from about 5 cm to about 12 cm in length and up to about 4 cm across or in diameter. The packet pocket may have dimensions of form about 13 cm to about 18 cm in length and up to about 4 cm in depth and about 4 cm to about 7 cm in width. The dispenser pocket can have a shorter length than the packet pocket so that a dispensing pump can be operated by the end user without the need to remove the liquid or powder dispenser from the flexible pouch. Additionally, the dispenser pocket can have a drain (as simple as a slit) in the bottom to allow any excess liquid to drain out of the pocket.

Returning now to FIGS. 7 and 8, the flexible pouch may include two pockets 102 and 112. Pocket 102 is a packet pocket that can hold a commercial packaged product 116. In this particular embodiment, the commercial packaged product 116 is a packet of facial tissues that can be dispensed from pocket 102 through slot 122. Dispensed tissue 123 is shown exiting slot 122. Pocket 112 is a dispenser pocket and is shown with liquid dispenser 114 contained within. The liquid dispenser 114 may be, for example, a container of lotion with a pump head. The flexible pouch may further include a grommet 120, to which a connecting device can be attached. The length of pocket 112 (dispenser pocket) may be shorter than the length of pocket 102 (packet pocket) to allow the end user to operate the pump head on liquid dispenser 114 without removing liquid dispenser 114 from pocket 112.

As used herein, the terms "substantially" or "generally" refer to the complete or nearly complete extent or degree of an action, characteristic, property, state, structure, item, or result. For example, an object that is "substantially" or "generally" enclosed would mean that the object is either completely enclosed or nearly completely enclosed. The exact allowable degree of deviation from absolute completeness may in some cases depend on the specific context. However, generally speaking, the nearness of completion will be so as to have generally the same overall result as if absolute and total completion were obtained. The use of "substantially" or "generally" is equally applicable when used in a negative connotation to refer to the complete or near complete lack of an action, characteristic, property, state, structure, item, or result. For example, an element, combination, embodiment, or composition that is "substantially free of" or "generally free of" an element may still actually contain such element as long as there is generally no significant effect thereof.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

Additionally, as used herein, the phrase "at least one of [X] and [Y]," where X and Y are different components that may be included in an embodiment of the present disclosure, means that the embodiment could include component X without component Y, the embodiment could include the component Y without component X, or the embodiment could include both components X and Y. Similarly, when used with respect to three or more components, such as "at least one of [X], [Y], and [Z]," the phrase means that the embodiment could include any one of the three or more components, any combination or sub-combination of any of the components, or all of the components.

In the foregoing description various embodiments of the present disclosure have been presented for the purpose of illustration and description. They are not intended to be exhaustive or to limit the invention to the precise form disclosed. Obvious modifications or variations are possible in light of the above teachings. The various embodiments were chosen and described to provide the best illustration of the principals of the disclosure and their practical application, and to enable one of ordinary skill in the art to utilize the various embodiments with various modifications as are suited to the particular use contemplated. All such modifications and variations are within the scope of the present disclosure as determined by the appended claims when interpreted in accordance with the breadth they are fairly, legally, and equitably entitled.

What is claimed is:

1. A carrying case comprising:

a main body, the main body having an interior, a first compartment, and a second compartment, wherein the first compartment has an aperture in a wall thereof, the aperture being configured for receiving an item from first compartment such that the item may be dispensed from the interior of the main body;

a pocket, the pocket being disposed on an outer surface of the main body and being sized to hold a dispenser, the pocket having an open top edge and a front panel, the front panel having an opening there through, the opening being configured for providing access to an item in a dispenser placed in the pocket;

a closure, the closure closing the main body and the open top edge of the pocket, wherein, when the closure closes the main body and the open top edge of the pocket, each of the aperture and the opening remain accessible;

a first connecting device provided at an upper corner of the main body and configured for attachment to a leash; and a second connecting device provided on a rear surface of the carrying case and configured for attachment to a belt or pant waist.

2. The carrying case of claim 1, wherein the closure is a flap.

3. The carrying case of claim 1, wherein the aperture is provided along a side surface of the main body.

4. The carrying case of claim 1, wherein the aperture is provided along a back surface of the main body.

5. The carrying case of claim 1, wherein the first connecting device is a carabineer clip.

6. The carrying case of claim 1, wherein the second connecting device is a clip.

7. The carrying case of claim 1, wherein the dispenser is a resealable packet of wipes and wherein the pocket is configured for receiving the resealable packet of wipes and wherein a wipe may be removed from the packet in the pocket through the opening in the pocket.

8. The carrying case of claim 1, further comprising a strap.

9. The carrying case of claim 8, further comprising a fixing device for fixing the strap in a storage position.

10. The carrying case of claim 9, wherein the fixing device is a hook and eye closure.

11. The carrying case of claim 2, wherein the main body has an open upper edge and wherein the flap extends over the open upper edge of the main body and extends over at least part of the front panel of the pocket.

12. A carrying case comprising:

a main body, the main body having a top edge, an interior, a first compartment, and a second compartment, wherein the first compartment has an aperture in a wall thereof, the aperture being configured for receiving an item from the first compartment such that the item may be dispensed from the interior of the main body;

a pocket, the pocket being disposed on an outer surface of the main body and being sized to hold a dispenser, the pocket having a top edge and a front panel, the front panel having an opening there through, wherein the opening is configured for accessing an item placed in the pocket;

a flap closure, the flap closure extending over the top edge of the main body and the top edge of the pocket to close the carrying case, wherein, when the carrying case is closed by the flap closure, the aperture and the opening remain accessible;

a carabineer clip at an upper corner of the main body;

a clip on a rear surface of the main body; and a strap, wherein a fixing mechanism is provided to fix the strap in a storage position.

* * * * *